United States Patent [19]

Gawler et al.

[11] Patent Number: 4,735,138

[45] Date of Patent: Apr. 5, 1988

[54] ELECTROMECHANICAL DRIVES FOR FRANKING MACHINES

[75] Inventors: David A. Gawler, Brentwood; Stephen C. Barratt, Hornchurch, both of England

[73] Assignee: Roneo Alcatel Limited, Essex, England

[21] Appl. No.: 28,754

[22] Filed: Mar. 23, 1987

[30] Foreign Application Priority Data

Mar. 25, 1986 [GB] United Kingdom ..... 8607365

[51] Int. Cl.[4] ..... G07B 17/02; B41J 3/50; B41J 29/00

[52] U.S. Cl. ..... 101/91

[58] Field of Search ..... 101/91; 235/101

[56] References Cited

FOREIGN PATENT DOCUMENTS 2079223 1/1982 United Kingdom ..... 101/91

*Primary Examiner*—Clifford D. Crowder

*Attorney, Agent, or Firm*—Shoemaker and Mattare, Ltd.

[57] ABSTRACT

An electromechanical drive for a franking machine comprises a module in which an electic motor controlled by an electronic circuit formed on a printed circuit board is manufactured as a modular unit by mounting the motor, mechanical drive components and a position sensor on the substrate of the printed circuit board. This module is mounted on a further module consisting solely of mechanical components and the drive components of the two modules are thereby drivingly engaged. This construction leads to economies in manufacture and ease of servicing because no electrical connections are required between the modules and hence assembly and dis-assembly of the circuit board and mechanical component module are made easier.

15 Claims, 2 Drawing Sheets

ELECTROMECHANICAL DRIVES FOR FRANKING MACHINES

BACKGROUND OF THE INVENTION

This invention relates to electromechanical drives and in particular to the construction of apparatus comprising a combination of electronic circuitry and an electromechanical drive for use in postage franking machines.

In franking machines for printing a postal franking on mail items, settable printing elements must be set to the required value of franking prior to effecting the printing operation. Current franking machines utilise electronic circuitry for entering the desired value of franking into a register or memory and for effecting the various accounting operations which need to be carried out during use of the machine. Accordingly it is convenient to utilise electromechanical drives controlled by the electronic circuitry to physically set the mechanical printing elements to the required settings.

Stepper motors have been proposed for setting the print elements, the shaft of the stepper motor being provided with a pinion engaging with a toothed rack and the distant end of the rack having further teeth engaging a toothed wheel rotatable with a rotatable printing element. Rotation of the stepper motor through one or more steps causes the rack to be moved longitudinally and this movement of the rack results in rotational movement of the printing element.

In franking machines it is essential that at all times there is verification that the printing elements are set to the required position corresponding to the franking value entered into the machine and on which the accounting functions will be based. For this reason, means are provided to sense the setting of the printing elements and to provide control signals during resetting of the printing elements from one value to another value. Generally the franking machine must be able to print franking values represented by a number of digits and hence the machine is provided with, for example, four printing elements each individually settable.

In known constructions of franking machine, the stepper motors have been mechanically mounted on a frame member of the machine. This member also carries the mechanical components for setting and retaining the printing elements in positions corresponding to the required franking value. A printed circuit board carrying the electronic components is secured to the frame member and flying leads provide electrical connections between the stepper motors and the printed circuit board. In addition the position sensors for the printing elements are mechanically coupled to the racks and electrically connected to the printed circuit board. Such a construction has disadvantages in manufacture in that electrical connections have to be provided between what is essentially a mechanical assembly and an electronic circuit board and, if the sensors are mounted on the circuit board, it is also necessary to provide operational mechanical connections between them. This form of construction is not convenient when servicing of the machine is required.

SUMMARY OF THE INVENTION

According to one aspect of the present invention a franking machine includes an electromechanical drive assembly comprising a printed circuit board consisting of an electrically insulating substrate carrying a plurality of electrically conductive tracks; electronic components mounted on said substrate and electrically interconnected by said electrically conductive tracks; an electric motor mounted on said substrate; electrical connections between said electric motor and conductive tracks of said plurality of conductive tracks.

According to another aspect of the invention a franking machine includes a first assembly comprising mechanical components including one or more printing elements settable to print a selected franking value; means operable to set said printing elements; a second assembly secured to said first assembly and comprising a printed circuit board consisting of an electrically insulating substrate carrying a plurality of electrically conductive tracks; electronic components mounted on said substrate and electrically interconnected by said electrically conductive tracks; an electric motor mounted on said substrate; electrical connections between said electric motor and conductive tracks of said plurality of conductive tracks; and a mechanical drive connection between the motor power output shaft and said means to set the printing elements whereby the printing elements on the first assembly are set to print a selected franking value by operation of the motor on the second assembly.

Preferably a sensor is provided electrically connected to conductive tracks of said plurality of conductive tracks and responsive to the position of one of said mechanical elements coupled to the motor power output shaft to provide an electrical signal representing the position of that mechanical element.

DESCRIPTION OF THE PREFERRED EMBODIMENT

Figure 1:
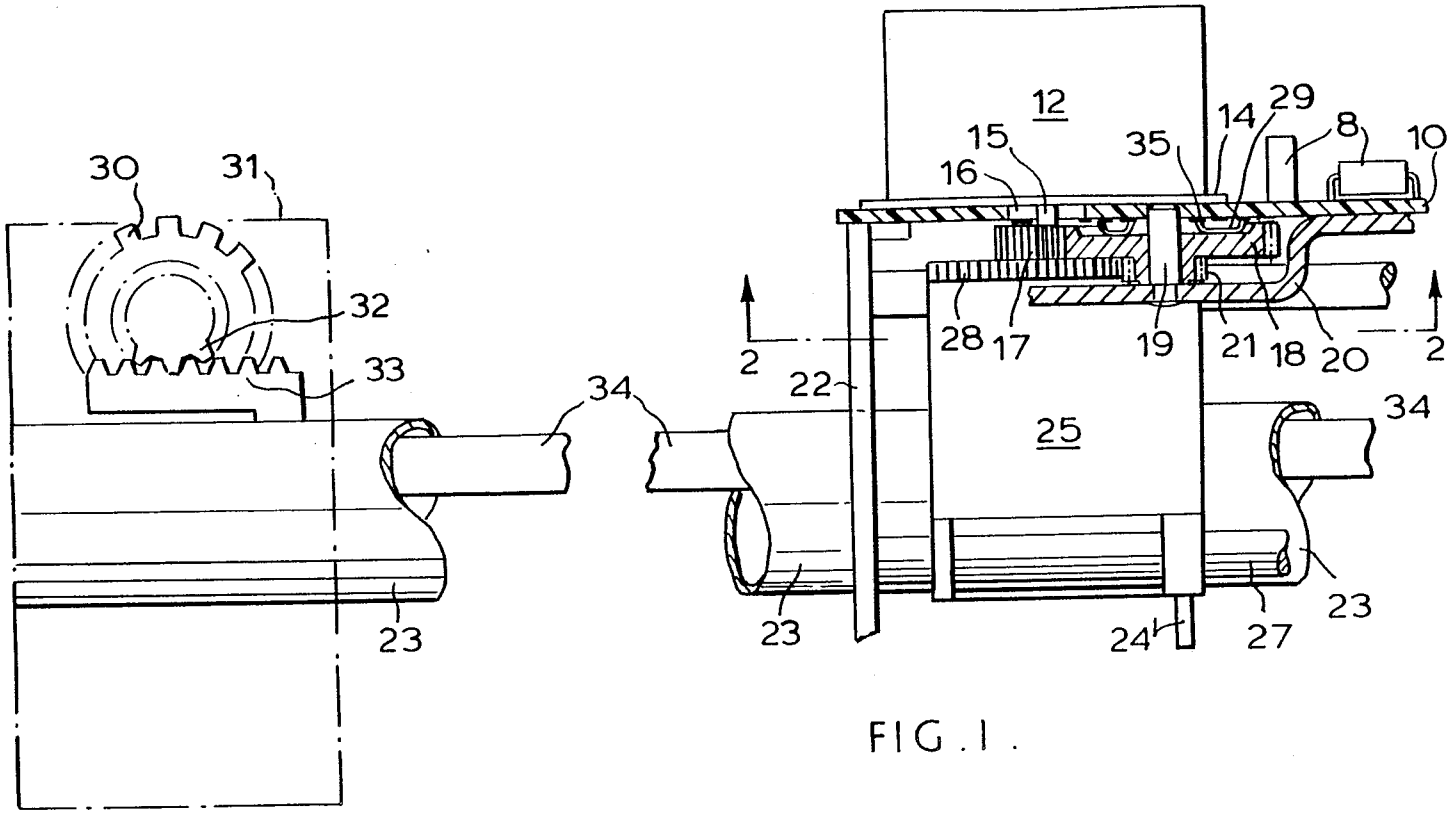
FIG. 1 is a side view partly in section of an electromechanical drive assembly mounted on a mechanical assembly and FIG. 2 is an underneath view in section on the line 2—2 of FIG. 1.
Figure 2:
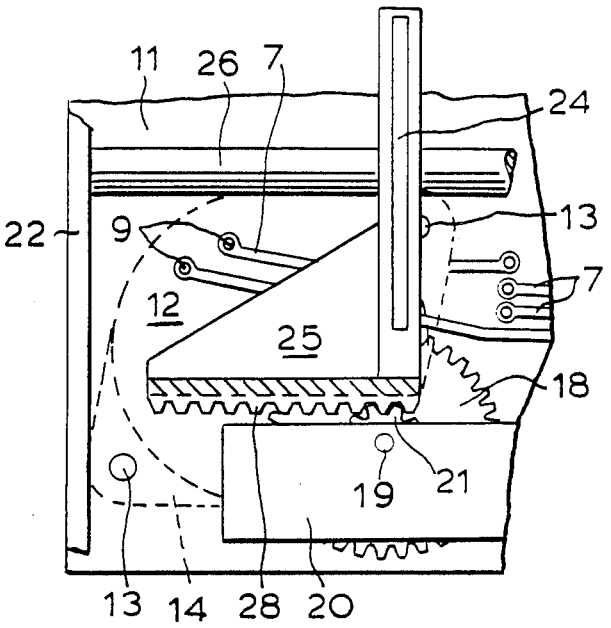

Referring to the drawings, a printed circuit board 10 comprises a rigid substrate 11 of electrically non-conductive material. The circuit board is of conventional construction and has, on one or both surfaces of the substrate, a pattern of electrically conductive tracks 7 to provide interconnections between electronic components 8 forming an electronic circuit. The construction of printed circuit boards and the mounting of electronic components thereon to form electronic circuits is well known and hence it is considered unnecessary for an understanding of the present invention to describe such construction in detail. A stepper motor 12 is mounted on the substrate 11 and rigidly secured thereto by means of screws 13 engaging a base plate 14 of the motor. Electrical connections 9 are made between the conductive tracks 7 of the electronic circuit and terminals of the motor. For this purpose the motor may be provided with terminal pins which protrude through the substrate or it may be provided with flying leads which are connected to terminal pins secured in the substrate and connected to the conductive tracks. The motor has a power output shaft 15 extending through an aperture 16 in the substrate 11. The shaft 15 projects beyond the face of the substrate and carries a drive pinion 17. The pinion 17 engages an intermediate pinion 18 rotatably mounted on a stub shaft 19. The stub shaft 19 is secured to a bracket 20 rigidly mounted on the substrate 11. The free end of the stub shaft engages in a further aperture in the substrate. An output pinion 21 is formed integrally with the intermediate pinion 18 and rotates with the intermediate pinion.

The printed circuit substrate, with the motor and gear train mounted thereon, is mounted on a frame 22 of a postal franking machine. This frame member carries an assembly of mechanical components whose function is the setting of print elements in a printing drum and then maintaining these elements in the required set position while a printing operation is effected by rotation of the drum. The constructional details of these components are not required for an understanding of the present invention and therefore it is considered to be unnecessary to describe in detail the construction of these mechanical components. Briefly, as shown in FIG. 1, the franking machine has rotatable printing elements 30 located in a printing drum 31 carried on the end of a hollow shaft 23. The printing elements can be set into angular positions corresponding respectively to franking values to be printed. Each printing element has a toothed wheel 32 formed integrally therewith, or secured thereto, engaged by teeth on a rack 33 which is movable longitudinally. The rack 33 is formed on one end of a selector bar 34 which extends through the hollow shaft 23 into the interior of the frame 22. The selector bar 34, adjacent its other end, is engaged by an annular member 24 rotatable with the hollow shaft 23 and slidable along the shaft. The periphery of the member 24 engages in a groove in a carriage 24 slidable on guides 26,27 parallel with the axis of the shaft 23. The carriage 25 has a linear row of teeth 28 with which the teeth of the pinion 21 mesh when the substrate 11 is mounted on the frame 22. It will be appreciated that rotation of the pinion 21 by the stepper motor 12 causes the carriage 25 to move parallel to the shaft 23. This movement of the carriage causes the annular member 24 to slide along the shaft 23 and, due to its engagement with the selector bar, to move the selector bar longitudinally of the shaft and hence cause the rack 33 to rotate the toothed wheel 32 and the printing element 30. Means not shown are provided to retain the printing element 30 in a precise angular position during rotation of the printing drum 31 by the shaft 23 such that it will effect printing of the desired value of franking.

By providing the gear train consisting of the pinions 17, 18 and 21 a smaller motor may be utilised for providing a required output torque than would otherwise be necessary for moving the rack and its associated printing element. However it will be appreciated that for a given rotational movement of the printing element the motor will now be required to execute a larger number of steps.

In order to control the motor such that the printing element 30 is set to a required angular position it is necessary to provide a sensor operative to generate signals, or from which signals can be derived, indicative of the position of the print element. One form of such a sensor is described in the specification of British Pat. No. 2034991. The sensor comprises a pattern of conductive tracks in the form of concentric part circular segments so arranged and interconnected that as they are swept by rotatable contacts a 2"out of 5"code signal is derived which represents the angular position of the rotatable contacts. A sensor of this type is provided in the present embodiment by electrical contacts 29 carried on a face of the intermediate pinion 18 adjacent the surface of the printed circuit board and concentric part circular conductive segments 35 formed by conductive tracks on the face of the substrate concentric with the axis of the stub shaft 19. Thus the intermediate pinion 18 serves not only to transmit mechanical torque from the motor to the slidable carriage but also carries the rotatable part of the angular position sensor.

As mentioned above, franking machines commonly are required to print franking values having up to four digits. Each printing element is formed to print a single digit and therefore four printing elements are provided each individually settable to a selected value. Thus although for clarity in the drawing only a single printing element and associated print setting elements and drive motor are shown, it is to be understood that a motor, gear train, sensor, carriage and selector bar are provided for each print element which it is desired to set to a selected position. Each motor, gear train and sensor with associated circuitry is carried on the one printed circuit substrate 11. The annular members 24 are disposed to slide along axially spaced portions of the shaft 23 and in order to achieve a compact construction the carriages 25 engaging two of the annular members 24 are disposed to one side of the shaft 23 and the carriages engaging the other two annular members are disposed to the other side of the shaft 23. A single guide 26 may serve to support all four of the carriages whereas two guides 27 may be provided, one to each side of the shaft 23, each supporting two of the carriages.

It will be appreciated that the construction described hereinbefore consists of a first module comprising a printed circuit board carrying electronic and electromechanical components and a second module comprising as assembly of mechanical components on which the printed circuit board of the first module is mounted. As a result the only operational interconnection required between the printed circuit board of the first module and the assembly of mechanical components comprising the second module is the meshing of the pinion 21 with the teeth 28 on the carriage 25. No electrical connections are needed between the modules. Thus the manufacture of the franking machine can be separated into two distinct operations, one being the assembly of mechanical components and the other being the assembly of electronic and electromechanical components. Furthermore when servicing of the machine becomes necessary access to the mechanical components is easily effected by removal of the first module. The electronic and electromechanical part of the machine forming the first module can be tested as an integral unit.

We claim:

1. A franking machine including an electromechanical drive assembly comprising a printed circuit board consisting of an electrically insulating substrate of planar form carrying a plurality of electrically conductive tracks; electronic components mounted on said substrate and electrically interconnected by said electrically conductive tracks; an electric motor mounted on one face of the substrate; a power output shaft of the motor extending through the thickness of the substrate and projecting from the other face of the substrate; and electrical connections between said electric motor and conductive tracks of said plurality of conductive tracks.

2. A franking machine as claimed in claim 1 wherein the assembly includes mechanical power transmission elements mechanically coupled to the power output shaft of the motor and carried by the substrate of the printed circuit board.

3. A franking machine as claimed in claim 2 including a sensor electrically connected to conductive tracks of said plurality of conductive tracks and responsive to the position of one of said mechanical elements coupled to the motor power output shaft to provide an electrical signal representing the position of that mechanical element.

4. A franking machine as claimed in claim 3 wherein said one mechanical element is rotatable; the sensor comprises electrical contacts carried by said one element and a pattern of electrical conductor segments on the substrate engaged by said electrical contacts.

5. A franking machine as claimed in claim 4 including a train of meshed gears operative to transmit mechanical power from the motor power output shaft wherein the electrical contacts of the sensor are carried by one of said gears in said train.

6. A franking machine including a first assembly comprising mechanical components including at least one printing element settable to print a selected franking value; means operable to set said printing element; a second assembly secured to said first assembly and comprising a printed circuit board consisting of an electrically insulating substrate of planar form carrying a plurality of electrically conductive tracks; electronic components mounted on said substrate and electrically interconnected by said electrically conductive tracks; an electric motor mounted on one face of the substrate; a power output shaft of the motor extending through the thickness of the substrate and projecting from the other face of the substrate; electrical connections between said electric motor and conductive tracks of said plurality of conductive tracks; and a mechanical drive connection between the motor power output shaft and said means to set the printing elements whereby the printing elements on the first assembly are set to print a selected franking value by operation of the motor on the second assembly.

7. A franking machine as claimed in claim 6 wherein the second assembly includes mechanical power transmission elements mechanically coupled to the power output shaft of the motor and carried by the substrate of the printed circuit board.

8. A franking machine as claimed in claim 7 including a sensor electrically connected to conductive tracks of said plurality of conductive tracks and responsive to the position of one of said mechanical elements coupled to the motor power output shaft to provide an electrical signal representing the position of that mechanical element.

9. A franking machine as claimed in claim 8 wherein said one mechanical element is rotatable; the sensor comprises electrical contacts carried by said one element and a pattern of electrical conductor segments on the substrate engaged by said electrical contacts.

10. A franking machine as claimed in claim 9 wherein said mechanical elements comprise a train of meshed gears carried by the substrate and operative to transmit mechanical power from the motor power output shaft wherein the electrical contacts of the sensor are carried by one of said gears in said train.

11. A franking machine as claimed in claim 10 wherein the means operable to set the printing element includes a member movable linearly and operatively connected to one of said print elements; a linear row of teeth on said member; and wherein one of the gears of the train engages with said teeth.

12. A franking machine including an electromechanical drive assembly comprising a printed circuit board consisting of a planar substrate of electrically insulating material carrying a plurality of electrically conductive tracks; a plurality of electronic components mounted on said substrate; an electric motor mounted on said substrate; mechanical power output means for said motor; a position sensor carried by said substrate and comprising a first element secured to said substrate and a second element operatively coupled to said power output means and movable relative to the first element by energisation of said motor; said electrically conductive tracks interconnecting said electronic components, said motor and said first element of said sensor.

13. A franking machine including:

a first assembly comprising mechanical components including mechanical means settable to print a selected franking value; a second assembly comprising a printed circuit board consisting of an electrically insulating substrate and a plurality of electrically conductive tracks carried by said substrate; electronic components mounted on said substrate; an electric motor mounted on said substrate; mechanical power transmission means operatively coupled to said motor; a position sensor mounted on said substrate operatively coupled to said power transmission means; said electrically conductive tracks electrically interconnecting said motor, said electronic components and said sensor to form a control circuit for said motor;

means mounting said second assembly on said first assembly; and an operative coupling between said first and second assemblies, said operative coupling consisting solely of mechanical elements for transmitting drive from said power transmission means of the second assembly to said mechanical means settable to print a selected franking value of the first assembly.

14. A franking machine as claimed in claim 13 wherein said power transmission means includes at least one gear wheel and said position sensor comprises a first set of contacts carried by said substrate and a second set of contacts carried by said gear wheel.

15. A franking machine including franking value setting means comprising a first assembly mounted on a second assembly; said second assembly comprising mechanical means for setting print means to print a selected value of franking; said first assembly comprising a printed circuit board consisting of an electrically insulating substrate carrying a plurality of electrically conductive tracks; electronic components, an electric motor and a position sensor mounted on said substrate and electrically interconnected by said electrically conductive tracks; an operative mechanical drive connection between said position sensor and said motor; said first and second assemblies being operatively interconnected solely by mechanical power transmission means operative to transmit drive from said motor to said mechanical means for setting print means.

* * * * *